US006478409B1

(12) United States Patent
Naoi

(10) Patent No.: US 6,478,409 B1
(45) Date of Patent: Nov. 12, 2002

(54) PRINTING APPARATUS AND PRINTING CONTROL METHOD

(75) Inventor: Masaaki Naoi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/489,913

(22) Filed: Jan. 24, 2000

(30) Foreign Application Priority Data

Jan. 27, 1999 (JP) ..... 11-019075

(51) Int. Cl.[7] ..... B41J 2/05
(52) U.S. Cl. ..... 347/57
(58) Field of Search ..... 347/54, 56, 57, 347/12, 13

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,525,727 A | * | 6/1985 | Kohashi et al. | 347/13 |
| 4,558,333 A | | 12/1985 | Sugitani et al. | 346/140 |
| 4,723,129 A | | 2/1988 | Endo et al. | 346/1.1 |
| 4,740,796 A | | 4/1988 | Endo et al. | 346/1.1 |
| 6,264,297 B1 | * | 7/2001 | Ayata et al. | 347/12 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Anh T. N. Vo
*Assistant Examiner*—An H. Do
(74) *Attorney, Agent, or Firm*—Fitzpatrick, Cella, Harper & Scinto

(57) ABSTRACT

A printing apparatus and a printing control method. After an odd-numbered block designation signal to select an odd-numbered block among a plurality of blocks of the printhead is generated and outputted to the printhead, and an even-numbered block designation signal to select an even-numbered block is generated and outputted to the printhead, these signals are output-controlled such that drive to the odd-numbered block and drive to the even-numbered block are started alternately. On the other hand, when an odd-numbered block HB heat signal to drive HBs included in the odd-numbered block is generated and outputted to the printhead, and an even-numbered block HB heat signal to drive HBs included in the even-numbered block is generated and outputted to the printhead, these heat signals are output-controlled such that output of the even-numbered block HB heat signal is started prior to completion of output of the odd-numbered block HB heat signal.

25 Claims, 9 Drawing Sheets

ODD_BLOCK(0)
ODD_BLOCK(1)
FIRST BLOCK
THIRD BLOCK
FIFTH BLOCK
ODD_IHEET(1)
ODD_IHEET(2)
ODD_IHEET(3)
ODD_IHEET(4)
EVEN_BLOCK(0)
EVEN_BLOCK(1)
SECOND BLOCK
FOURTH BLOCK
SIXTH BLOCK
EVEN_IHEET(1)
EVEN_IHEET(2)
EVEN_IHEET(3)
EVEN_IHEET(4)
FIRST BLOCK
HE(1)
HE(2)
HE(3)
HE(4)
SECOND BLOCK
HE(5)
HE(6)
HE(7)
HE(8)
THIRD BLOCK
HE(9)
HE(10)
HE(11)
HE(12)
FOURTH BLOCK
HE(13)
HE(14)
HE(15)
HE(16)
FIFTH BLOCK
HE(17)
HE(18)
HE(19)
HE(20)
SIXTH BLOCK
HE(21)
HE(22)
HE(23)
HE(24)

PRINTING APPARATUS AND PRINTING CONTROL METHOD

BACKGROUND OF THE INVENTION

This invention relates to a printing apparatus and a printing control method, and more particularly, to a printhead for performing printing in accordance with an ink-jet method, and an ink-jet printing apparatus and a printing control method using the printhead.

In a conventional long printing-width ink-jet printhead, a heater board having about 64, 128 or 256 printing elements is integrated in one chip (hereinbelow, referred to as a "heater board (HB)"), and a plurality of HBs are arrayed and attached onto a base plate with high precision. The printhead has ink channels and ink discharge orifices (hereinbelow, referred to as "discharge orifices") corresponding to the printing elements of the respective HBs.

The printhead is controlled by using printing element designation signals, common to all the HBs, for designating the printing elements of the HBs, and heat control signals prepared in HB units. The recent long printing-width printhead (hereinafter referred to as a "line type head") has 20 or more HBs mounted on its base plate. As the number of control signals from a print control circuit to the line type head increases, heat control signals for the respective HBs in the line type head are generated with block designation signals for dividing the HBs into several blocks and driving the HBs in block units and HB heat signals common to all the blocks, so that increment in the number of control signals outputted to the line type head is suppressed.

FIG. 8 is a block diagram showing the construction of a driving circuit which drives a printhead having 24 HBs by dividing the 24 HBs into 6 blocks by 4 blocks.

In FIG. 8, reference numeral 1 denotes a print control circuit which generates various print control signals; 2, a decoder which converts binary code data designating blocks into signals corresponding to the respective blocks; 3, a 2-input AND gate which outputs an effective heat signal to an HB when a block designation signal and a heat signal corresponding to the HB in the block are both effective; 4 to 9, blocks each including 4 HBs; 10, HBs; and 13, a line type head.

Note that a block denoted by numeral 4 is a first block; a block denoted by numeral 5, a second block; a block denoted by numeral 6, a third block; a block denoted by numeral 7, a fourth block; a block denoted by numeral 8, a fifth block; and a block denoted by numeral 9, a sixth block.

Further, numeral 101 denotes binary code block designation signals BLOCK (0–2), designating a block to be driven; 102, block heat signals BHEET (1–6) for the respective blocks; 103, HB heat signals IHEET (1–4) for the respective HBs 10 in the respective blocks; and 104, heat enable signals HE (1–24) for the respective HBs 10.

FIG. 9 is a timing chart showing the respective signals used in the driving circuit as shown in FIG. 8.

In FIG. 9, all the block designation signals BLOCK (0–2) are turned to "LOW" to designate the first block, and the HB heat signals IHEET (1–4) are sequentially turned to "HIGH" for the four HBs 10 in the first block, to drive the four HBs 10 in the first block. Next, the block designation signals BLOCK (0–2) are turned to "HIGH", "LOW", and "LOW" respectively, to designate the second block, and the HB heat signals IHEET (1–4) are sequentially turned to "HIGH" to drive the four HBs 10 in the second block.

The HBs 10 in the third to sixth blocks are driven in a similar manner. Thus, print control is performed on the 24 HBs 10 by the print control circuit by using only 7 signal lines, for the block designation signals BLOCK (0–2) 101 and the HB heat signals IHEET (1–4) 103.

In case of the above-described conventional line type head, if drive to one HB has been completed and then the next HB is driven, the printing time is long and the speed of printing is lowered, however, if a plurality of HBs are simultaneously driven, as the maximum electric consumption during the drive increases, a power source having a large current capacity is required. Accordingly, as shown in the timing chart of FIG. 9, within a block, the respective HBs are driven while heating start timing is shifted little by little within a range avoiding much increment in electric consumption, so that the printing time is shortened.

For this purpose, in the above-described conventional art, within a block, as the HB heat signals IHEET (1–4) are provided for the respective HBs, the above print control to shift the heating start timing can be easily realized. However, when print operation moves from one block to the other block, the HB drive cannot be started before completion of the HB drive in the previous block. Thus the continuity in the drive is broken.

Further, in recent line type heads, as several tens of HBs are mounted, the number of blocks in print control is large in correspondence with the considerably large number of HBs, and the number of occurrence of discontinuity in drive between blocks is larger. As a result, the printing speed in the entire printhead is further lowered.

SUMMARY OF THE INVENTION

Accordingly, it is an object of the present invention to provide a printing apparatus and a printing control method which improve continuity in time-division block drive in a printhead and realize high speed printing.

According to one aspect of the present invention, the foregoing object is attained by providing a printing apparatus that performs printing on a print medium by dividing a plurality of printing elements included in a printhead into a plurality of blocks and time-divisionally driving the respective blocks, comprising: first selection-signal generation output means for generating a first selection signal to select an odd-numbered block from the plurality of blocks and outputting the first selection signal to the printhead; second selection-signal generation output means for generating a second selection signal to select an even-numbered block from the plurality of blocks and outputting the second selection signal to the printhead; first drive-signal generation output means for generating a first drive signal to drive printing elements included in the odd-numbered block and outputting the first drive signal to the printhead; second drive-signal generation output means for outputting a second drive signal to drive printing elements included in the even-numbered block and outputting the second drive signal to the printhead; and control means for output-controlling the first and second selection signals such that drive to the odd-numbered block and drive to the even-numbered block are started alternately, and controlling the first and second selection-signal generation output means and the first and second drive-signal generation output means such that an output of the second drive signal to drive the printing elements included in the even-numbered block is started prior to completion of an output of the first drive signal to drive the printing elements included in the odd-numbered block.

According to another aspect of the present invention, the foregoing object is attained by providing a printing apparatus that performs printing on a print medium by dividing a plurality of printing elements included in a printhead into a plurality of blocks and time-divisionally driving the respective blocks, comprising: selection-control signal generation output means for generating a selection control signal to select an odd-numbered block and an even-numbered block from the plurality of blocks and outputting the selection control signal to the printhead; first drive-signal generation output means for generating a first drive signal to drive printing elements included in the odd-numbered block and outputting the first drive signal to the printhead; second drive-signal generation output means for generating a second drive signal to drive printing elements included in the even-numbered block and outputting the second drive signal to the printhead; and control means for output-controlling the selection control signal such that drive to the odd-numbered block and drive to the even-numbered block are started alternately, and controlling the first and second selection-signal generation output means and the first and second drive-signal generation output means such that an output of the second drive signal to drive the printing elements included in the even-numbered block is started prior to completion of an output of the first drive signal to drive the printing elements included in the odd-numbered block.

In the above construction, it is preferable that the printhead includes: a first selection-signal generation circuit that generates a first selection signal to select the odd-numbered block based on the selection control signal; and a second selection-signal generation circuit that generates a second selection signal to select the even-numbered block based on the selection control signal.

In any of these constructions, the number of the printing elements included in the odd-numbered block and the even-numbered block is two or more, and the first drive signal and the second drive signal respectively comprise a plurality of signal pulses so as to respectively drive the plurality of printing elements. The plurality of signal pulses are sequentially outputted at predetermined time intervals.

Note that it is preferable that the printhead is an ink-jet printhead that performs printing by discharging ink. In this case, it is more preferable that the ink-jet printhead has electrothermal transducers to generate thermal energy to be supplied to the ink, so as to discharge the ink by utilizing the thermal energy.

According to still another aspect of the present invention, the foregoing object is attained by providing a printing control method for performing printing on a print medium by dividing a plurality of printing elements included in a printhead into a plurality of blocks and time-divisionally driving the respective blocks, comprising: a first selection-signal generation output step of generating a first selection signal to select an odd-numbered block from the plurality of blocks and outputting the first selection signal to the printhead; a second selection-signal generation output step of generating a second selection signal to select an even-numbered block from the plurality of blocks and outputting the second selection signal to the printhead; a first control step of output-controlling the first and second selection signals such that drive to the odd-numbered block and drive to the even-numbered block are started alternately; a first drive-signal generation output step of generating a first drive signal to drive printing elements included in the odd-numbered block and outputting the first drive signal to the printhead; a second drive-signal generation output step of generating a second drive signal to drive printing elements included in the even-numbered block and outputting the second drive signal to the printhead; and a second control step of output-controlling the first and second drive signals such that an output of the second drive signal to drive the printing elements included in the even-numbered block is started prior to completion of an output of the first drive signal to drive the printing elements included in the odd-numbered block.

In accordance with the present invention as described above, among the plurality of blocks of the printhead, the first selection signal to select an odd-numbered block is generated and outputted to the printhead, and among the plurality of blocks, the second selection signal to select an even-numbered block is generated and outputted to the printhead. The first and second selection signals are output-controlled such that the drive to the odd-numbered block and the drive to the even-numbered block are alternately started. Further, when the first drive signal to drive the printing elements included in the odd-numbered block is generated and outputted to the printhead, and the second drive signal to drive the printing elements included in the even-numbered block is generated and outputted to the printhead, the first and second drive signals are output-controlled such that the output of the second drive signal is started before completion of the output of the first drive signal.

According to still another aspect of the present invention, the foregoing object is attained by providing a printing apparatus that performs printing on a print medium by dividing a plurality of printing elements included in a printhead into a plurality of blocks and time-divisionally driving the respective blocks, comprising: selection-signal generation output means for generating selection signals by using at least two circuits corresponding to at least two structurally-adjacent blocks among the plurality of blocks, to select the at least two blocks, and outputting the selection signals to the printhead; drive-signal generation output means for generating at least two drive signals to drive printing elements included in the respective two structurally-adjacent blocks and outputting the at least two drive signals to the printhead; and control means for output-controlling the selection signals such that drive-start timings of the at least two structurally-adjacent blocks are different from each other, and controlling the selection-signal generation output means and the drive-signal generation output means to control start and end of output of the at least two drive signals such that a period of driving printing elements included in one block of the at least two structurally-adjacent blocks and a period of driving printing elements included in another block overlap with each other.

According to still another aspect of the present invention, the foregoing object is attained by providing a printing control method for performing printing on a print medium by dividing a plurality of printing elements included in a printhead into a plurality of blocks and time-divisionally driving the respective blocks, comprising: a selection-signal generation output step of generating selection signals by using at least two circuits corresponding to at least two structurally-adjacent blocks among the plurality of blocks, to select the at least two blocks, and outputting the selection signals to the printhead; a drive-signal generation output step of generating at least two drive signals to drive printing elements included in the respective two structurally-adjacent blocks and outputting the at least two drive signals to the printhead; and a control step of output-controlling the selection signals such that drive-start timings of the at least two structurally-adjacent blocks are different from each other, and controlling the selection-signal generation output step and the drive-signal generation output step to control start and end of output of the at least two drive signals such that a period of driving printing elements included in one block of the at least two structurally-adjacent blocks and a period of driving printing elements included in another block overlap with each other.

According to still another aspect of the present invention, the foregoing object is attained by providing a printhead that performs printing on a print medium by dividing a plurality of printing elements into a plurality of blocks and time-divisionally driving the respective blocks, comprising: at least two selection-signal generation output circuits that generate and output at least two selection signals in correspondence with at least two structurally-adjacent blocks among the plurality of blocks, to select the at least two structurally-adjacent blocks from the plurality of blocks; and a drive signal receiving unit that receives at least two drive signals to drive printing elements included in the respective at least two structurally-adjacent blocks; wherein the at least two selection signals are output-controlled such that drive start timings of the at least two structurally-adjacent blocks are different from each other, and wherein control is performed by the at least two drive signals such that a period of driving printing elements included in one block of the at least two structurally-adjacent blocks and a period of driving printing elements included in another block overlap with each other.

The invention is particularly advantageous since when drive moves from one block to the next block, printing elements of the respective blocks can be continuously driven.

Thus, the discontinuity in drive to the printing elements, that occurred between blocks in the conventional printing is prevented, and printing can be performed at a higher speed.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Outline of Apparatus Main Body>

Figure 1:
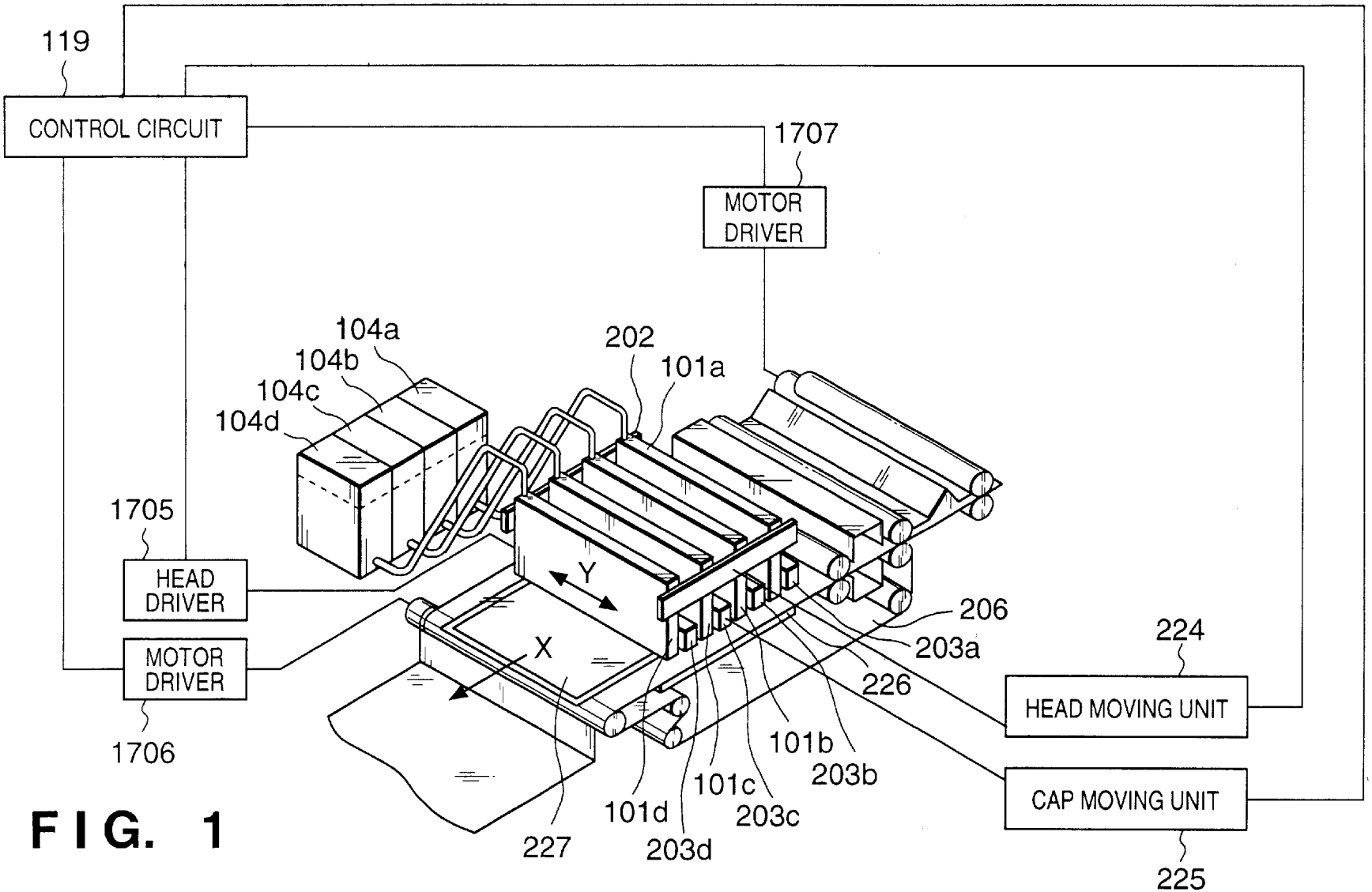
FIG. 1 is a perspective view showing the structure of an ink-jet printer IJRA as a typical embodiment of the present invention.

FIG. 1 is a perspective view showing the structure of an ink-jet printer IJRA as a typical embodiment of the present invention.

As shown in FIG. 1, the ink-jet printer IJRA has full line type printheads 101*a* to 101*d* each having a plurality of discharge orifices arrayed in correspondence with the printing width of a print medium. These full line type printheads are fixedly supported by a holder 202 in parallel at predetermined intervals in a direction X. Faced-down 3008 discharge orifices are provided, at 360 dpi intervals in one line along a direction Y, on the bottom surfaces of the respective printheads. This arrangement enables a printing width of 212 mm.

These printheads have a plurality of heater boards and employ a method to discharge ink by utilizing thermal energy. The printheads are discharge-controlled by a head driver 1705 as drive signal supply means.

Note that the respective printheads and the holder 202 construct a head unit, which is movable in up-and-down directions by a head moving unit 224.

Further, head caps 203*a* to 203*d*, adjacent to each other, corresponding to the respective printheads, are provided in the lower parts of the respective printheads. The interior portions of the respective head caps have ink absorbers such as sponges inside.

Note that the caps are fixed by another holder (not shown), and the holder and the caps construct a cap unit, which is movable in the direction X by a cap moving unit 225.

The respective printheads are supplied with cyan, magenta, yellow and black color ink through ink supply tubes from ink tanks 104*a* to 104*d*, for color printing.

Further, the ink supply is made by utilizing capillarity of ink supply passages. The liquid surfaces in the respective ink tanks are set to lower levels than the positions of the discharge orifices by a predetermined distance.

Further, the ink-jet printer IJRA has a seamless belt 206 chargeable as conveyance means for conveying a print sheet as the print medium or a cloth 227.

The seamless belt 206 is routed with various rollers in a predetermined path, connected to a driving roller, and turned by a conveyance motor driven by a motor driver 1706. Further, the seamless belt 206 runs in the direction X, immediately below the discharge orifices of the printheads 101*a* to 101*d*, while its downward deflection is suppressed by a fixed support member 226.

All the head driver 1705, the motor drivers 1706 and 1707, the head moving unit 224 and the cap moving unit 125 are controlled by a control circuit 119.

<Construction of Control Circuit>

Next, the control construction for performing print control of the above-described printing apparatus will be described.

Figure 2:
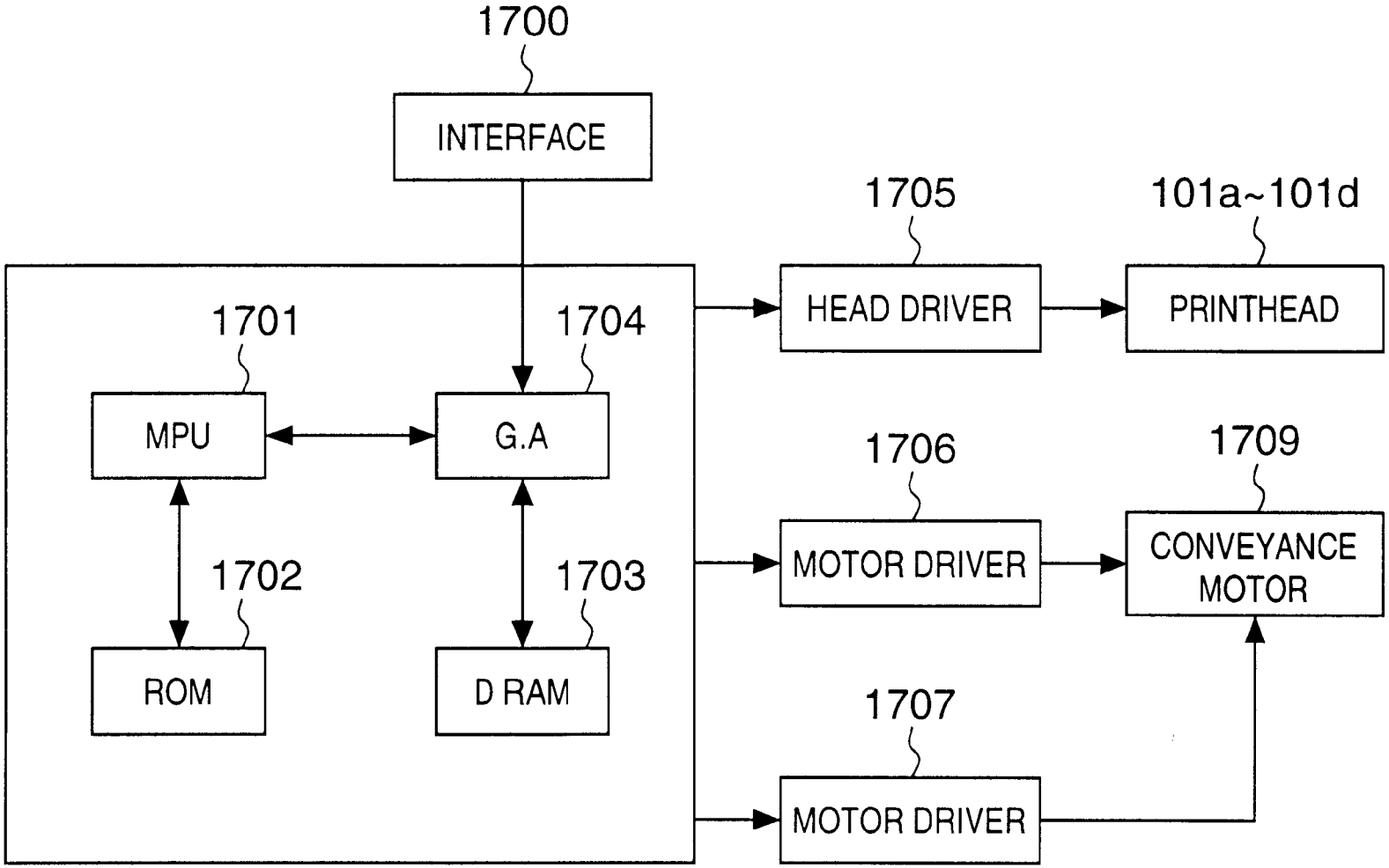
FIG. 2 is a block diagram showing the construction of a control circuit of the ink-jet printer IJRA.

FIG. 2 is a block diagram showing the construction of the control circuit 119 of the ink-jet printer IJRA. Referring to FIG. 2 showing the control circuit, reference numeral 1700 denotes an interface for inputting a print signal; 1701, an MPU; 1702, a ROM for storing a control program executed by the MPU 1701; and 1703, a DRAM for storing various data (the above-described print signal, print data supplied to the printhead and the like). Numeral 1704 denotes a gate array (G. A.) for performing supply control on print data to the printheads 101*a* to 101*d*. The gate array 1704 also performs data-transfer control among the interface 1700, the MPU 1701, and the RAM 1703. Numeral 1709 denotes a conveyance motor for conveying the print sheet; 1705, a head driver for driving the printheads 101*a* to 101*d*; and 1706 and 1707, motor drivers for driving the conveyance motor 1709.

The operation of the above control construction will be described below. When a print signal is inputted into the interface 1700, the print signal is converted into print data for a print operation between the gate array 1704 and the MPU 1701. The motor drivers 1706 and 1707 are driven, and the printheads 101*a* to 101*d* are driven in accordance with the print data supplied to the head driver 1705, thus print operation is performed.

The head driver 1705 transmits various print control signals to the driving circuits for the printheads 101*a* to 101*d* in accordance with the control by the MPU 1701.

Note that the ink tanks 104*a* to 104*d* and the printheads 101*a* to 101*d* may be integrally formed as an exchangeable ink cartridge IJC. Further, it may be arranged such that the ink tanks 104*a* to 104*d* and the printheads 101*a* to 101*d* can be separated, and when ink is exhausted, only the ink tanks 104*a* to 104*d* are exchanged for new ones.

Figure 3:
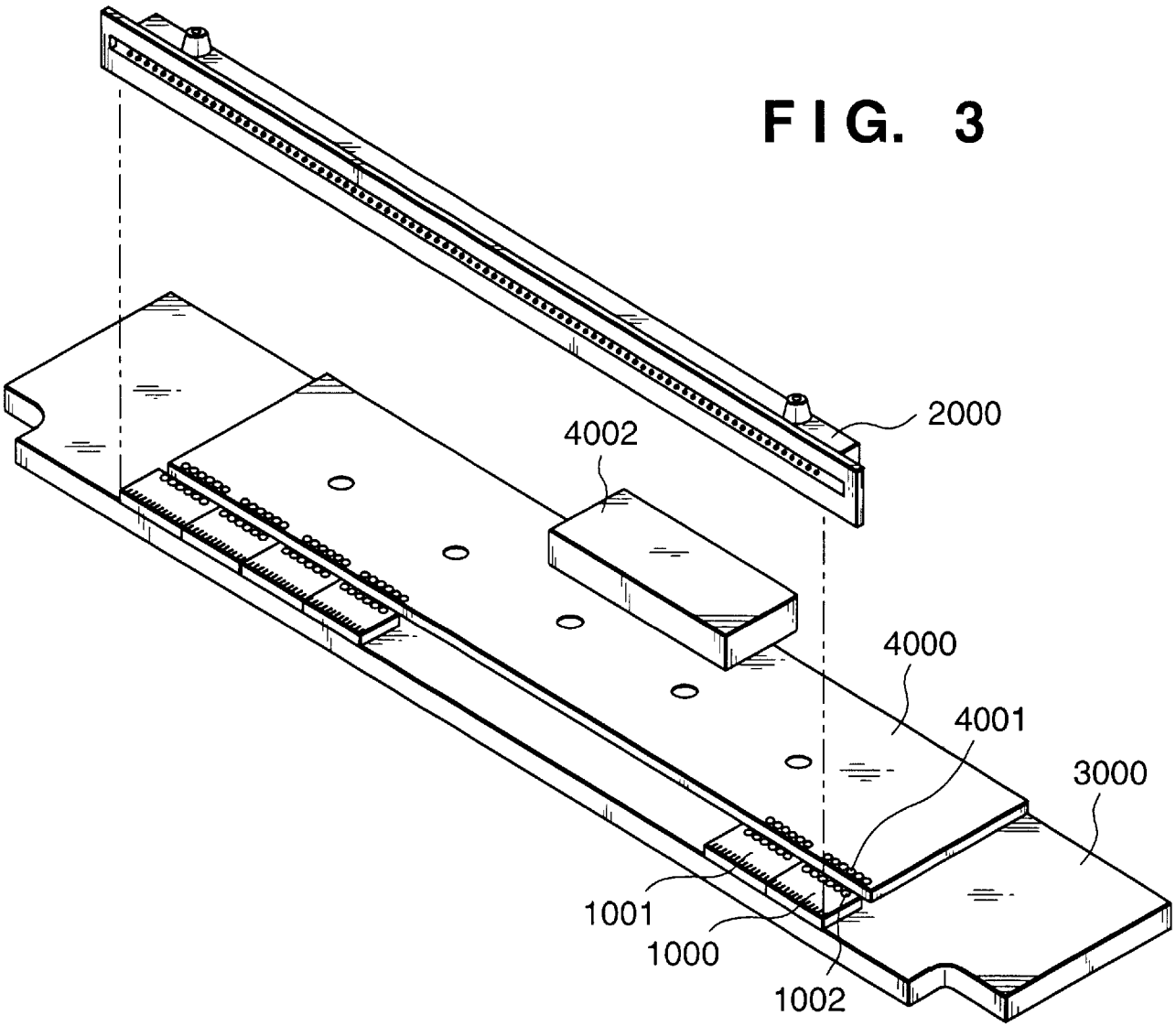
FIG. 3 is a perspective view showing the structure of a printhead 101*a;*

FIG. 3 is an exploded perspective view showing the construction of the printhead 101*a* of this embodiment. Note that the printheads 101*b* to 101*d* respectively have the same construction as that of the printhead 101*a*, the explanations of the constructions of the printheads 101*b* to 101*d* will be omitted. Further, in this embodiment, in the respective printheads 101*a* to 101*d*, the density of the ink discharge orifices is 360 dpi (the interval between adjacent ink discharge orifices is 70.5 $\mu$m), and the number of ink discharge orifices is 3008 (printing width is 212 mm).

As shown in FIG. 3, the print head 101*a* has a plurality of boards (hereinafter, referred to as "heater boards (HBs)") 1000. Each heater board 1000 has 128 printing elements 1001 at a density of 360 dpi in predetermined positions. In this embodiment, heat-generating resistors are employed as the printing elements. Further, signal pads for receiving signals from the outside to drive the printing elements 1001 at arbitrary timing, and electric pads 1002 to supply electric power or the like to drive the heat-generating resistors are provided on the heater boards. Further, circuit devices such as shift registers to parallel-output serially-inputted print signals to the printing elements 1001 are provided on the heater boards 1000.

Note that as the substrate of the heater board 1000, a plate member comprising monocrystalline silicon, polycristalline silicon, glass, metal or ceramic is employed.

The plurality of heater boards are fixedly bonded by using adhesive to the surface of a support body (base plate) 3000 comprising metal such as aluminum or stainless-steel or ceramic.

Further, as shown in FIG. 3, as in the case of the heater boards 1000, a wiring board 4000 is bonded to the base plate 3000. The bonding is made such that the pads 1002 on the heater boards 1000 and signal/power supply pads 4001 provided on the wiring board 4000 are in a predetermined positional relation. Further, a connector 4002 to supply external print signal and drive electric power is provided on the wiring board 4000.

A top plate 2000 has grooves to form ink channels corresponding to the printing elements 1001 provided on the heater boards 1000, orifices corresponding to the respective ink channels to discharge ink toward a print medium, a concave portion to form an ink chamber connected to the plurality of ink channels to supply the ink to the respective ink channels, and an ink supply orifice to introduce ink supplied from the ink tanks to the ink chamber, and the like. The top plate 2000 has a length almost covering the array of the printing elements formed by arranging the plurality of heater boards 1000.

In this embodiment, the top plate 2000 is combined with the base plate 3000 such that the ink channels and the printing elements 1001 of the heater boards 1000 arranged on the base plate 3000 are in a predetermined positional relation.

As described above, in the present embodiment, the full line type printhead according to the ink-jet method is constructed by arraying a plurality of heater boards having a plurality of printing elements, on one end of a base plate, and attaching a long top plate covering the array of printing elements to the base plate.

In the printhead having the above construction, ink is filled in the ink channels via a liquid chamber formed with the concave portion of the top plate, from the above-described ink supply orifice. In this manner, the filled ink is heated by application of electric signals to the printing elements. This heat causes film boiling in the ink, and the ink is discharged from the orifices by the pressure of bubble generated by the film boiling.

Figure 4:
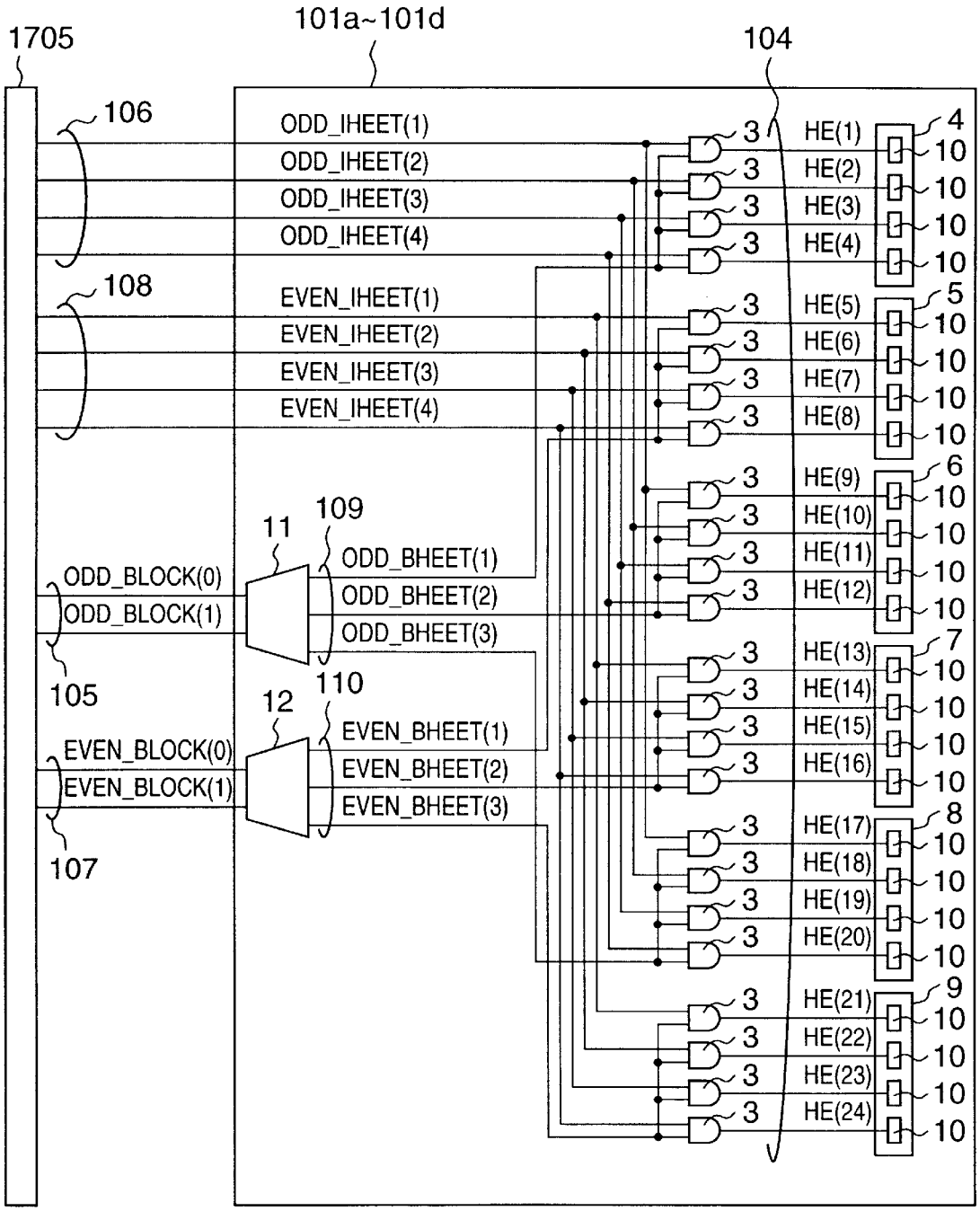
FIG. 4 is a block diagram showing the construction of a driving circuit of each of the printheads 101*a* to 101*d* and signal lines between the driving circuit and a head driver 1705.

FIG. 4 is a block diagram showing the construction of a driving circuit of each of the printheads 101*a* to 101*d* and signal lines between the driving circuit and the head driver 1705. As in the case of the conventional art in FIG. 8, the printheads 101*a* to 101*d* as shown in FIG. 4 respectively have 6 blocks each including 4 HBs (total 24 HBs), and are time-divisionally driven in each block. Accordingly, in FIG. 4, elements and signals corresponding to those described in FIG. 8 have the same reference numerals and symbols, and the explanations of the elements and signals will be omitted.

In FIG. 4, numeral 11 denotes an odd-numbered block decoder which converts binary code data (odd-numbered block designation number) designating odd-numbered blocks (the first, the third and the fifth blocks) into signals corresponding to the respective odd-numbered blocks; and 12, an even-numbered block decoder which converts binary code data (even-numbered block designation number) designating even-numbered blocks (the second, the fourth and the sixth blocks) into signals corresponding to the respective even-numbered blocks.

Numeral 105 denotes binary code odd-numbered block designation signals ODD_BLOCK (0, 1) designating an odd-numbered block to be driven; 106, odd-numbered block heat signals ODD_IHEET (1–4) for the respective odd-numbered blocks; 107, binary coded even-numbered block designation signals EVEN_BLOCK (0, 1) designating an even-numbered block to be driven; 108, even-numbered block heat signals EVEN_IHEET (1–4) for the respective even-numbered blocks; 109, odd-numbered block HB heat signals ODD_BHEET (1–3) for the respective HBs 10 in the odd-numbered blocks; and 110, even-numbered block HB heat signals EVEN_BHEET (1–3) for the respective HBs 10 in the even-numbered blocks.

Figure 5:
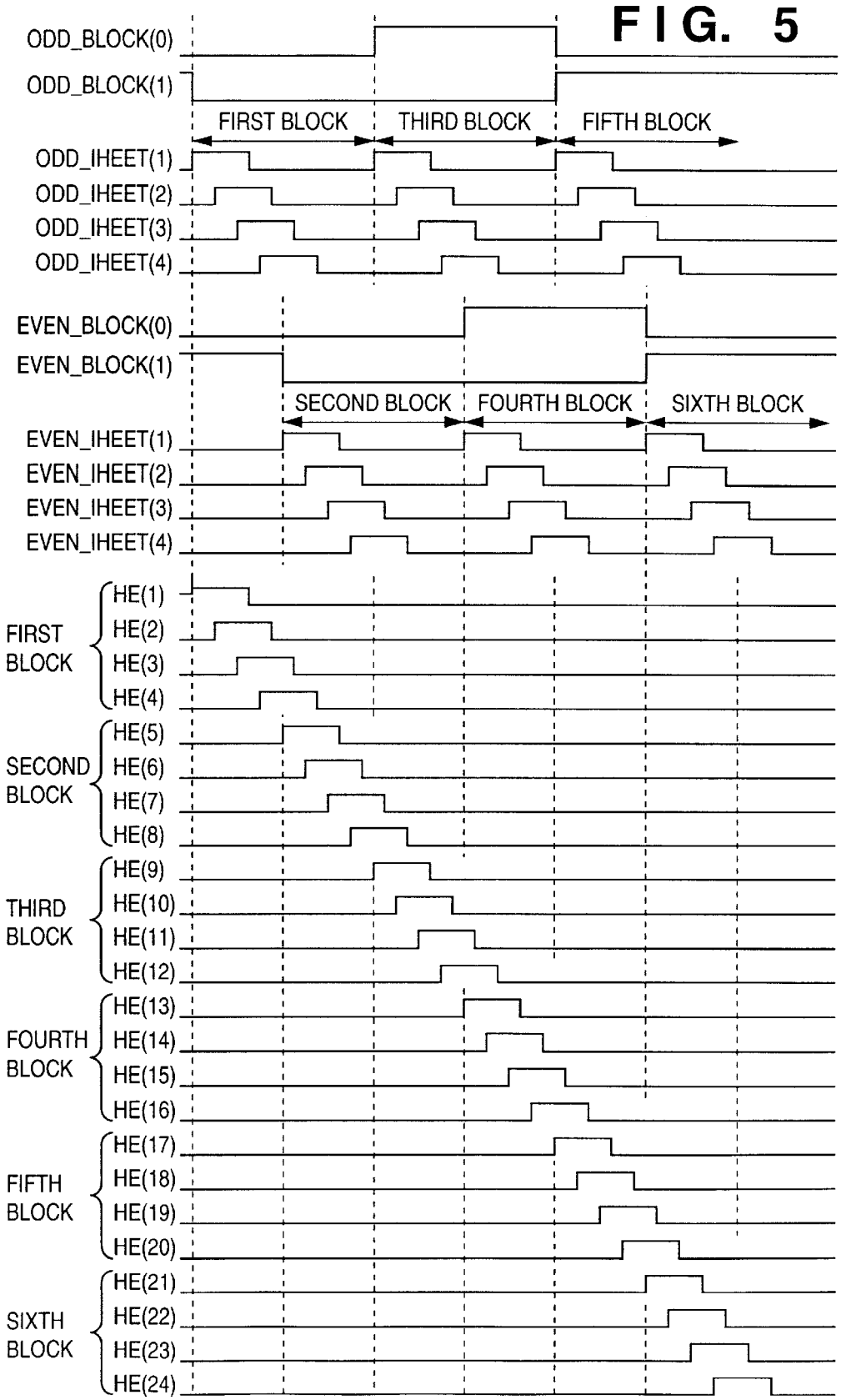
FIG. 5 is a timing chart showing respective signals used in the driving circuit as shown in FIG. 4.

FIG. 5 is a timing chart showing the respective signals used in the driving circuit as shown in FIG. 4.

Referring to FIG. 5, upon printing, the odd-numbered block designation signals ODD_BLOCK (0, 1) supplied from the head driver 1705 are respectively turned to "LOW" to designate the first block, then the odd-numbered block HB heat signals ODD_IHEET (1–4) are sequentially turned to "HIGH" at predetermined time intervals, to drive the respective HBs 10 in the block.

Then, to drive the second block, after the drive to the last HB 10 in the first block by the odd-numbered block HB heat signal ODD_IHEET (4) has been started, the even-numbered block designation signals EVEN_BLOCK (0,1) are respectively turned to "LOW" to designate the second block. Then the even-numbered block HB heat signals EVEN_IHEET (1–4) are sequentially turned to "HIGH" at predetermined intervals, to drive the respective HBs 10 in the block.

Then, to drive the third block, after the drive to the last HB 10 in the second block by the even-numbered block HB heat signal EVEN_IHEET (4) has been started, the odd-numbered block designation signals ODD_BLOCK (0,1) are turned to "HIGH" and "LOW" respectively to designate the third block. Then the odd-numbered block HB heat signals ODD_IHEET (1–4) are sequentially turned to "HIGH" at predetermined intervals, to drive the respective HBs 10 in the block.

Thereafter, similar control is performed until the sixth block has been driven.

According to the present embodiment as described above, the 6 blocks constructing the printhead are divided into even-numbered blocks and odd-numbered blocks and alternately driven such that the order is odd-numbered block→even-numbered block→odd-numbered block or the like. After the drive to the last HB in an odd-numbered block (or even-numbered block) has been started, the first HB in the next even-numbered block (or odd-numbered block) is driven. Thus, in this print control, even though HBs continuously driven belong to different blocks, all the HBs (24 HBs) can be sequentially driven at predetermined intervals with 12 signal lines.

Accordingly, discontinuity in print operation does not occur between blocks, and even in use of line type head having a large number of blocks, high speed printing can be performed.

[Another Embodiment]

Next, description will be made on a case where the odd/even-numbered block designation signals (ODD_BLOCK (0,1)/EVEN_BLOCK (0,1)) are generated inside the driving circuit of each of the printheads 101*a* to 101*d* so as to further reduce the number of signal lines between the head driver 1705 and the driving circuit for each of the printheads 101*a* to 101*d*.

Figure 6:
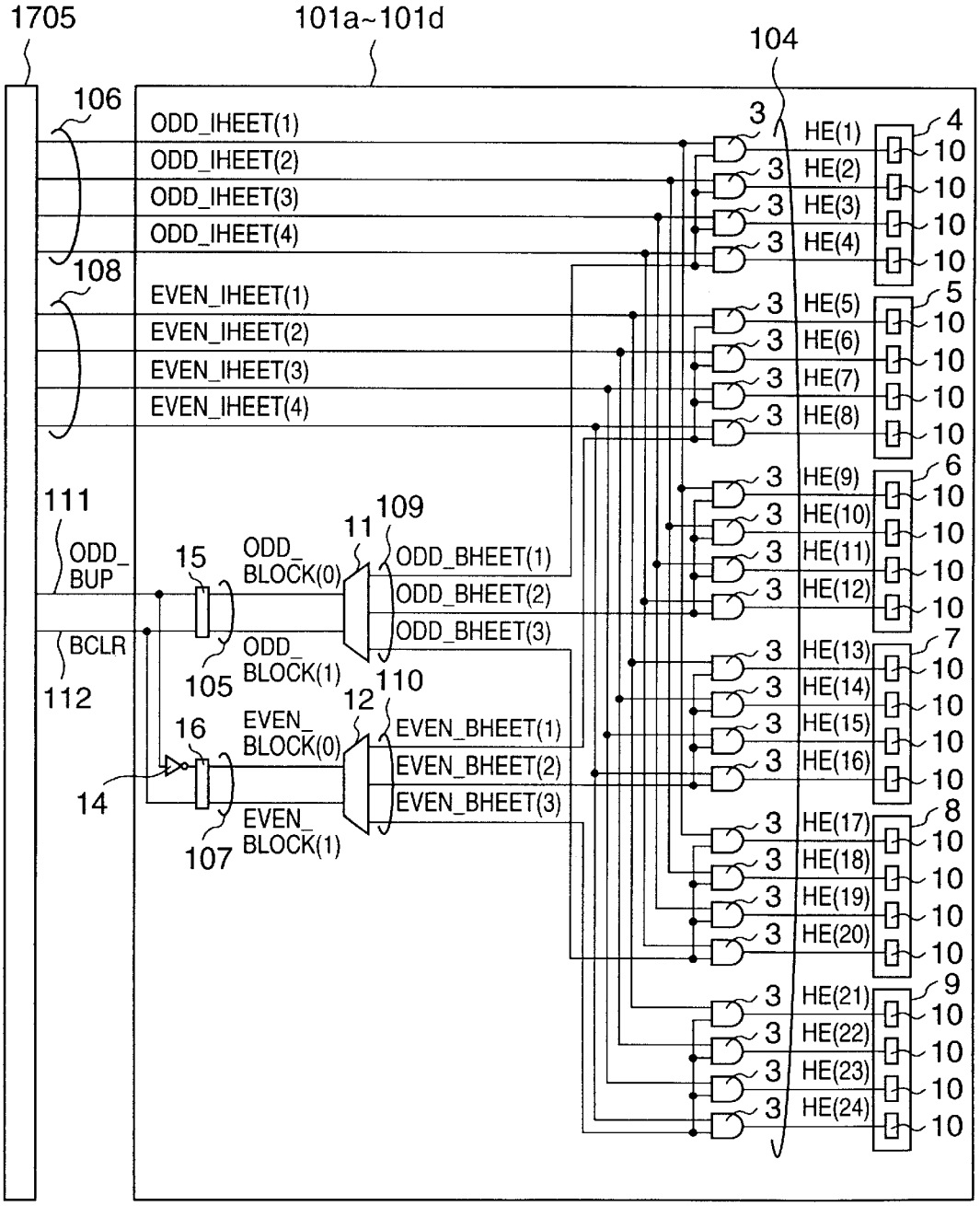
FIG. 6 is a block diagram showing the construction of the driving circuit of each of the printheads 101*a* to 101*d* and signal lines between the driving circuit and the head driver 1705, according to another embodiment.
Figure 8:
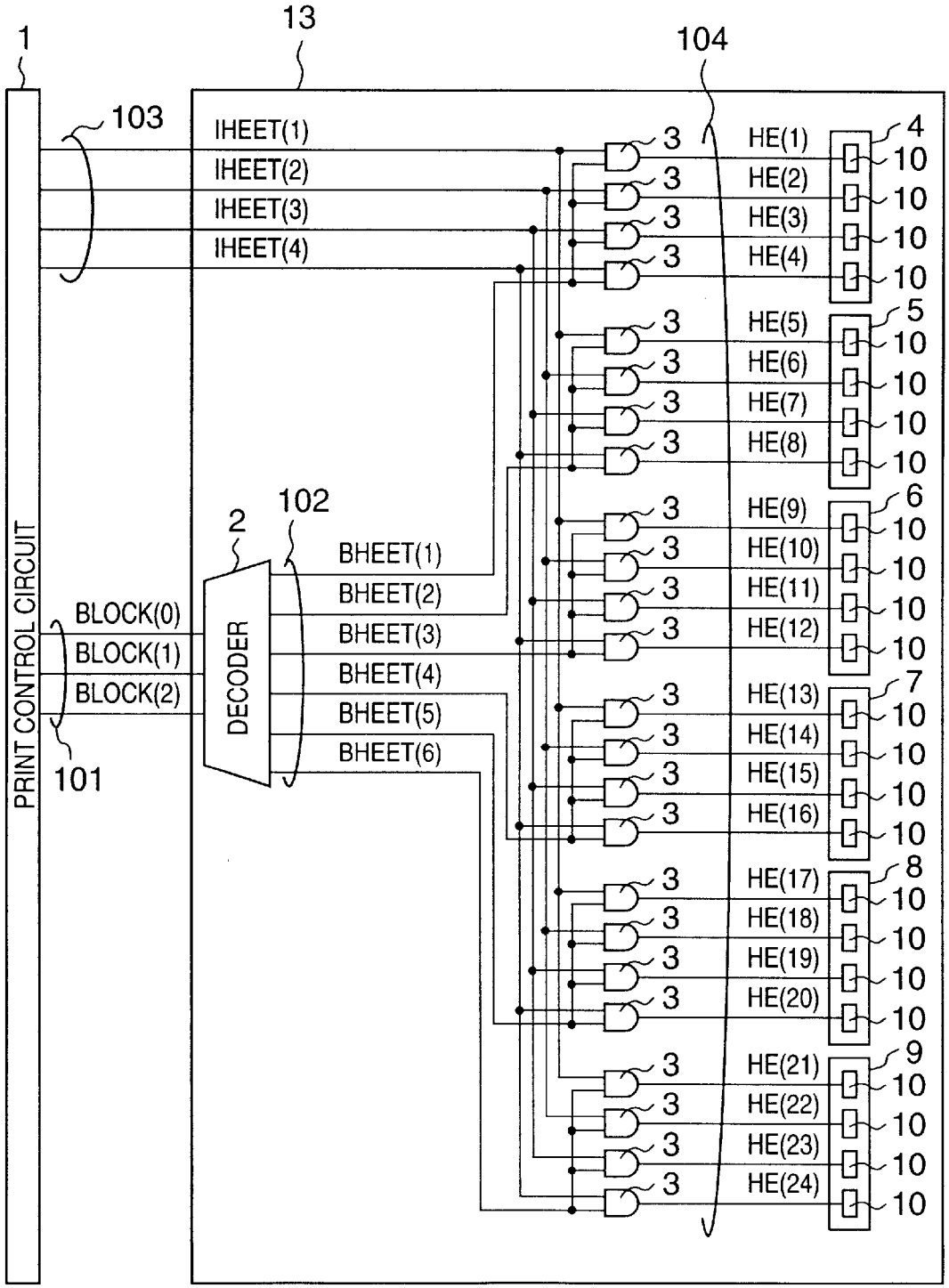
FIG. 8 is a block diagram showing the construction of the driving circuit which drives the printhead having 24 HBs by dividing the 24 HBs into 6 blocks by 4 HBs.
Figure 9:
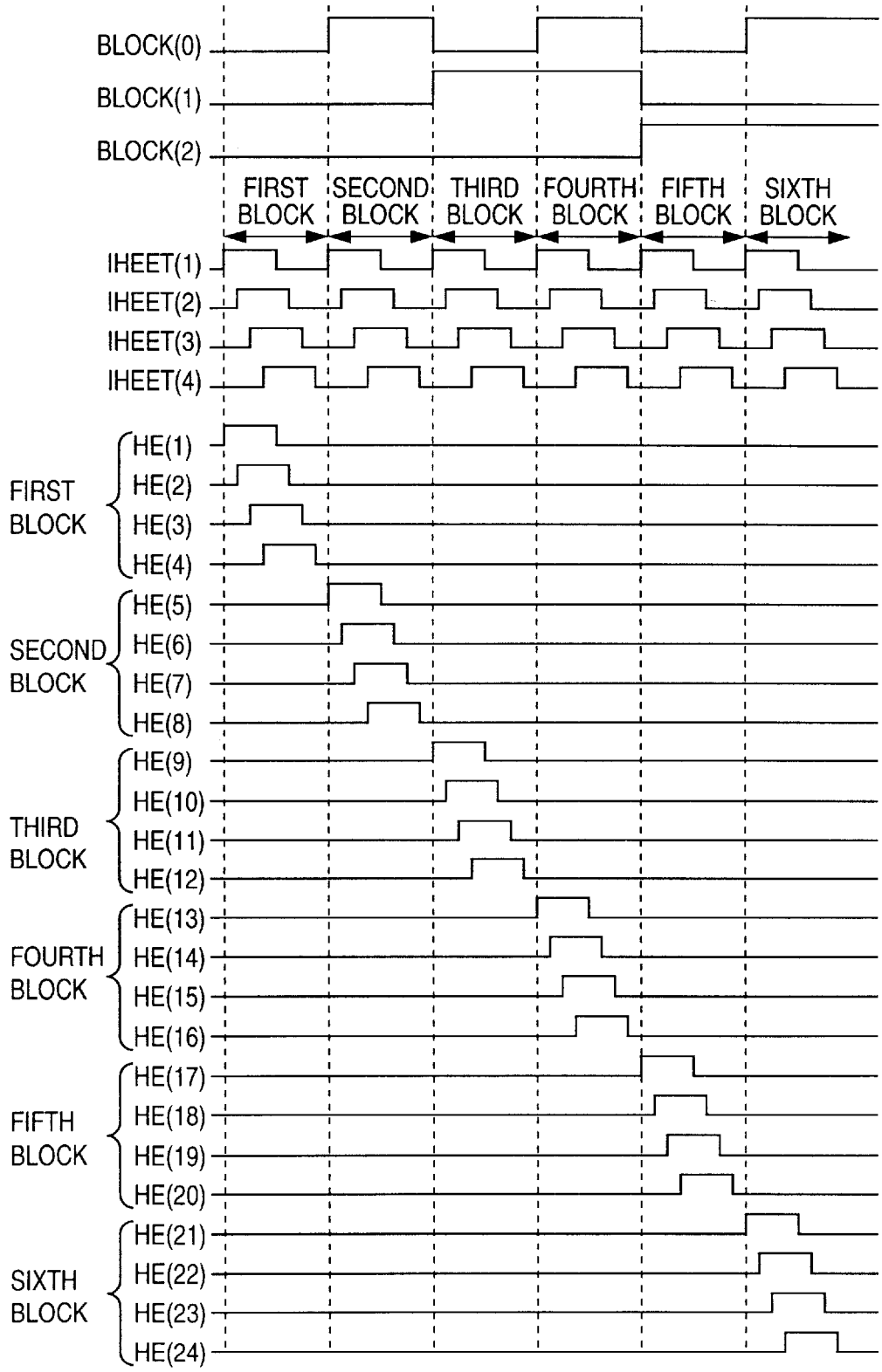
FIG. 9 is a timing chart showing the respective signals used in the driving circuit as shown in FIG. 8.

FIG. 6 is a block diagram showing the construction of the driving circuit of each of the printheads 101*a* to 101*d* and the signal lines between the driving circuit and the head driver 1705, according to this embodiment. As in the case of FIG. 4 showing the previous embodiment and FIG. 8 showing the conventional art, the printheads 101*a* to 101*d* as shown in FIG. 6 respectively have 6 blocks each including 4 HBs (total 24 HBs) and are time-divisionally driven in each block. Accordingly, the elements and signals described in FIGS. 4 and 8 have the same reference numerals and symbols and the explanations of the elements and signals will be omitted.

In FIG. 6, numeral 111 denotes an odd-numbered block addition signal ODD_BUP supplied from the head driver 1705; 14, an inverter gate for inverting the odd-numbered numbered block addition signal ODD_BUP into an even-numbered block addition signal; 15, an odd-numbered block counter, comprising an incremental counter with clearing function, for generating the odd-numbered block designation signals ODD_BLOCK (0,1); 16, an even-numbered block counter, comprising an incremental counter with clearing function, for generating the even-numbered block designation signals EVEN_BLOCK (0,1); and 112, a block-counter clear signal BCLR for initializing the odd-numbered block counter 15 and the even-numbered block counter 16.

The odd-numbered block counter 15 is incremented when the odd-numbered block addition signal ODD_BUP is changed from "LOW" to "HIGH", and is initialized for a period in which the block-counter clear signal BCLR is "HIGH". The even-numbered block counter 16 is incremented when the odd-numbered block addition signal ODD_BUP is changed from "HIGH" to "LOW", and is initialized for a period in which the block-counter clear signal BCLR is "HIGH".

Figure 7:
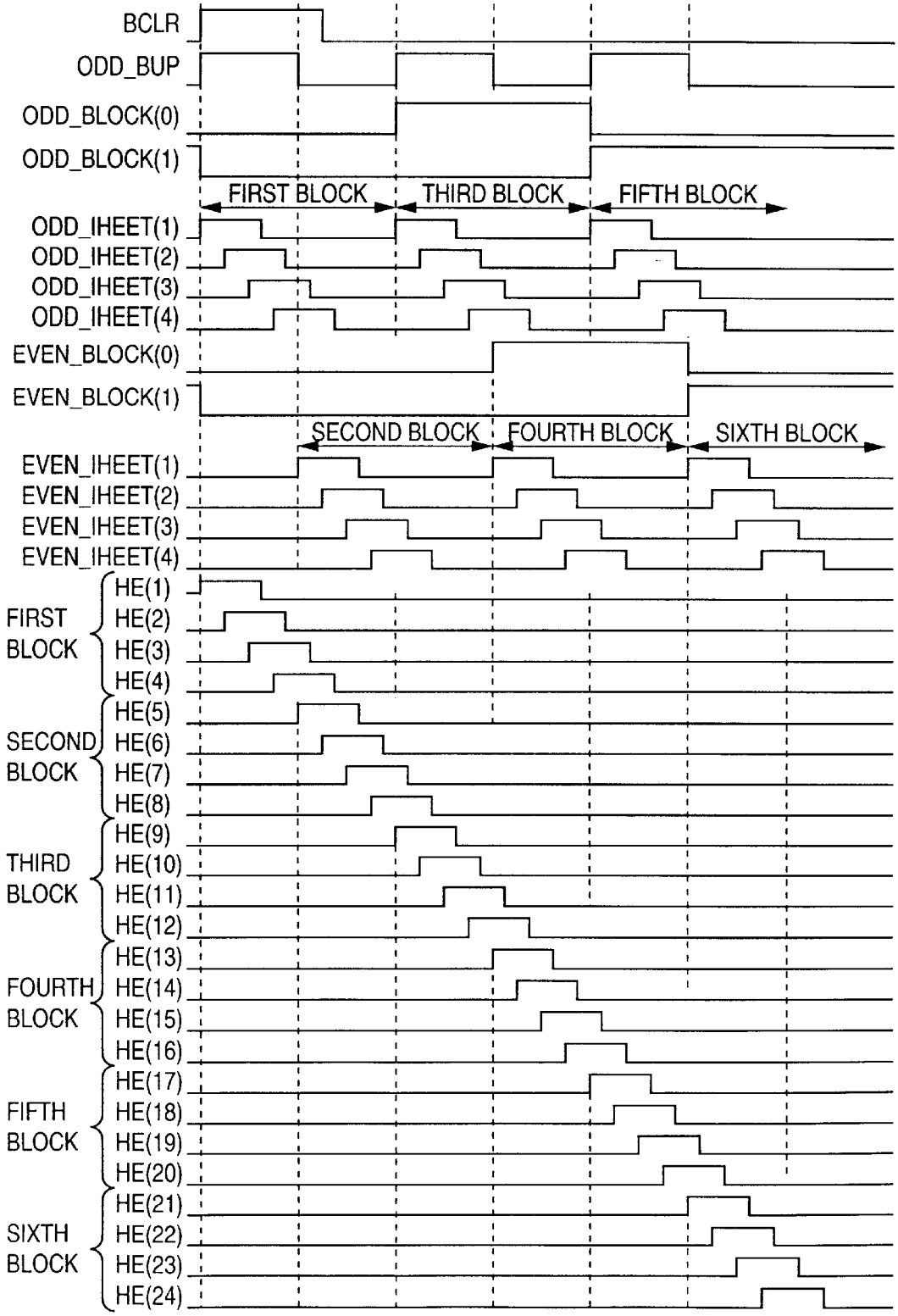
FIG. 7 is a timing chart showing respective signals used in the driving circuit as shown in FIG. 6.

FIG. 7 is a timing chart showing the respective signals used in the driving circuit as shown in FIG. 6.

In FIG. 7, first, as soon as the odd-numbered block addition signal ODD_BUP is turned from "LOW" to "HIGH", the block-counter clear signal BCLR is turned from "LOW" to "HIGH". The odd-numbered block counter 15 and the even-numbered block counter 16 are initialized, and the odd-numbered block counter 15 designates the first block, while the even-numbered block counter 16 designates the second block.

Thereafter, the odd-numbered block HB heat signals ODD_IHEET (1–4) are sequentially turned to "HIGH" at predetermined intervals. Thus the HBs in the first block are sequentially driven. After the drive to the fourth HB in the first block by the odd-numbered block HB heat signal ODD_IHEET (4) has been started, the odd-numbered block addition signal ODD_BUP is turned from "HIGH" to "LOW". At this time, as the block-counter clear signal BCLR is still "HIGH", the even-numbered block counter 16 is not incremented and still designates the second block. Thereafter, the block-counter clear signal BCLR is turned to "LOW".

On the other hand, when the odd-numbered block addition signal ODD_BUP is turned from "HIGH" to "LOW", the even-numbered block HB heat signals EVEN_IHEET (1–4) are sequentially turned to "HIGH" at predetermined intervals. Thus, the HBs in the second block are sequentially driven. After the drive to the fourth HB in the second block has been started, the odd-numbered block addition signal ODD_BUP is turned from "HIGH" again, to increment the odd-numbered block counter 15 to designate the third block.

Thereafter, the odd-numbered block HB heat signals ODD_IHEET (1–4) are sequentially turned to "HIGH" at predetermined intervals. Thus, the HBs in the third block are sequentially driven. After the drive to the fourth HB in the third block by the odd-numbered block HB heat signal ODD_IHEET (4) has been started, the odd-numbered block addition signal ODD_BUP is turned to "LOW", to increment the even-numbered block counter 16. The even-numbered block HB heat signals EVEN_IHEET (1–4) are sequentially turned to "HIGH" at predetermined intervals. Thus, the HBs in the fourth block are sequentially driven.

Thereafter, similar control is performed until the sixth block has been driven.

According to the present embodiment as described above, the number of control signal lines between the head driver 1705 and the driving circuit of each of the printhead is 10, i.e., two lines less than the number of signal lines in the previous embodiment. Further, even if the number of blocks increases, the number of control signal lines does not increase.

Further, in the above embodiment, the blocks to be driven are divided into odd-numbered blocks and even-numbered blocks, and to designate blocks which belong to the respective two types, two block counters 15 and 16 are provided, however, the present invention is not limited to this arrangement. For example, the blocks may be divided into three or more types, and for each block type, a circuit to designate a block which belongs to the block type may be provided. In this case, the number of the circuits is three or more.

Note that in a case where high-speed print operation is not a high priority, the maximum electric consumption can be reduced by using somewhat longer time interval between sequential application to the odd/even-block HB heat signals, so as to reduce the number of simultaneously driven HBs. In this arrangement, a small capacity power source can be employed for the apparatus, and downsizing and cost reduction can be attained. Further, a break in a current which occurs when print operation moves from a block to another block, as in the conventional print operation, can be prevented. Accordingly, the power supply becomes stable and the deleterious effect on the other parts of the apparatus due to variations in the power source can be suppressed.

Note that in the above embodiments, the liquid discharged from the printhead has been described as ink, and the liquid contained in the ink tank has been described as ink. However, the liquid is not limited to ink. For example, the ink tank may contain processed liquid or the like discharged to a print medium to improve fixability or water repellency of a printed image or to increase the image quality.

The embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Publication Laid-Open No. 59-123670 which discloses the arrangement using a slot common to a plurality of electrothermal transducers as a discharge portion of the electrothermal transducers, or Japanese Patent Publication Laid-Open No. 59-138461 which discloses the arrangement having an opening for absorbing a pressure wave of heat energy in correspondence with a discharge portion.

Furthermore, as a full line type printhead having a length corresponding to the width of a maximum print medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive ink from the apparatus main body upon being mounted on the apparatus main body can be employed as well as a cartridge type printhead in which an ink tank is integrally arranged on the printhead itself as described in the above embodiments.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

In addition, the printing apparatus of the present invention may be used in the form of a copying machine combined with a reader and the like, or a facsimile apparatus having a transmission/reception function in addition to an image output terminal of an information processing apparatus such as a computer integrated with or separately provided from the apparatus.

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can be also achieved by providing a storage medium storing program code for performing the aforesaid processes to a system or an apparatus, reading the program code with a computer (e.g., CPU, MPU) of the system or apparatus from the storage medium, then executing the program.

In this case, the program code read from the storage medium realize the functions according to the embodiments, and the storage medium storing the program code constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program code.

Furthermore, besides aforesaid functions according to the above embodiments are realized by executing the program code which are read by a computer, the present invention includes a case where an OS (operating system) or the like working on the computer performs a part or entire processes in accordance with designations of the program code and realizes functions according to the above embodiments.

Furthermore, the present invention also includes a case where, after the program code read from the storage medium are written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiments.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus that performs printing on a print medium by dividing a plurality of printing elements included in a printhead into a plurality of blocks and time-divisionally driving the respective blocks, comprising:

first selection-signal generation output means for generating a first selection signal to select an odd-numbered block from said plurality of blocks and outputting the first selection signal to said printhead;

second selection-signal generation output means for generating a second selection signal to select an even-numbered block from said plurality of blocks and outputting the second selection signal to said printhead;

first drive-signal generation output means for generating a first drive signal to drive printing elements included in said odd-numbered block and outputting the first drive signal to said printhead;

second drive-signal generation output means for outputting a second drive signal to drive printing elements included in said even-numbered block and outputting the second drive signal to said printhead; and control means for output-controlling the first and second selection signals such that drive to said odd-numbered block and drive to said even-numbered block are started alternately, and controlling said first and second selection-signal generation output means and said first and second drive-signal generation output means such that an output of the second drive signal to drive the printing elements included in said even-numbered block is started prior to completion of an output of the first drive signal to drive the printing elements included in said odd-numbered block.

2. The apparatus according to claim 1, wherein the number of the printing elements included in said odd-numbered block and said even-numbered block is two or more, and wherein the first drive signal and the second drive signal respectively comprise a plurality of signal pulses so as to respectively drive said plurality of printing elements.

3. The apparatus according to claim 2, wherein the plurality of signal pulses are sequentially outputted at predetermined time intervals.

4. The apparatus according to claim 1, wherein said printhead is an ink-jet printhead that performs printing by discharging ink.

5. The apparatus according to claim 4, wherein said ink-jet printhead has electrothermal transducers to generate thermal energy to be supplied to the ink, so as to discharge the ink by utilizing the thermal energy.

6. A printing apparatus that performs printing on a print medium by dividing a plurality of printing elements included in a printhead into a plurality of blocks and time-divisionally driving the respective blocks, comprising:

selection-control signal generation output means for generating a selection control signal to select an odd-numbered block and an even-numbered block from said plurality of blocks and outputting the selection control signal to said printhead;

first drive-signal generation output means for generating a first drive signal to drive printing elements included in said odd-numbered block and outputting the first drive signal to said printhead;

second drive-signal generation output means for generating a second drive signal to drive printing elements included in said even-numbered block and outputting the second drive signal to said printhead; and control means for output-controlling the selection control signal such that drive to said odd-numbered block and drive to said even-numbered block are started alternately, and controlling said first and second selection-signal generation output means and said first and second drive-signal generation output means such that an output of the second drive signal to drive the printing elements included in said even-numbered block is started prior to completion of an output of the first drive signal to drive the printing elements included in said odd-numbered block.

7. The apparatus according to claim 6, wherein the number of the printing elements included in said odd-numbered block and said even-numbered block is two or more, and wherein the first drive signal and the second drive signal respectively comprise a plurality of signal pulses so as to respectively drive said plurality of printing elements.

8. The apparatus according to claim 7, wherein the plurality of signal pulses are sequentially outputted at predetermined time intervals.

9. The apparatus according to claim 6, wherein said printhead is an ink-jet printhead that performs printing by discharging ink.

10. The apparatus according to claim 9, wherein said ink-jet printhead has electrothermal transducers to generate thermal energy to be supplied to the ink, so as to discharge the ink by utilizing the thermal energy.

11. The apparatus according to claim 6, wherein said printhead includes:

a first selection-signal generation circuit that generates a first selection signal to select said odd-numbered block based on the selection control signal; and a second selection-signal generation circuit that generates a second selection signal to select said even-numbered block based on the selection control signal.

12. A printing control method for performing printing on a print medium by dividing a plurality of printing elements included in a printhead into a plurality of blocks and time-divisionally driving the respective blocks, comprising:

a first selection-signal generation output step of generating a first selection signal to select an odd-numbered block from said plurality of blocks and outputting the first selection signal to said printhead;

a second selection-signal generation output step of generating a second selection signal to select an even-numbered block from said plurality of blocks and outputting the second selection signal to said printhead;

a first control step of output-controlling the first and second selection signals such that drive to said odd-numbered block and drive to said even-numbered block are started alternately;

a first drive-signal generation output step of generating a first drive signal to drive printing elements included in said odd-numbered block and outputting the first drive signal to said printhead;

a second drive-signal generation output step of generating a second drive signal to drive printing elements included in said even-numbered block and outputting the second drive signal to said printhead; and a second control step of output-controlling the first and second drive signals such that an output of the second drive signal to drive the printing elements included in said even-numbered block is started prior to completion of an output of the first drive signal to drive the printing elements included in said odd-numbered block.

13. A printing apparatus that performs printing on a print medium by dividing a plurality of printing elements into a plurality of blocks and time-divisionally driving the respective blocks, comprising:

control means for designating the respective blocks such that periods of designating the respective blocks partially overlap with each other; and control means for time-divisionally driving a plurality of printing elements in a designated block such that timings of driving the plurality of printing elements within the designated block partially overlap with each other.

14. The apparatus according to claim 13, that performs printing by discharging ink from discharge orifices provided in correspondence with said printing elements.

15. The apparatus according to claim 14, wherein said printing elements discharge the ink by generating thermal energy.

16. The apparatus according to claim 13, wherein successively designated blocks to be driven in the plurality of blocks are designated by a first signal and a second signal whose phase is shifted from that of the first signal.

17. The apparatus according to claim 13, wherein time-divisionally driven timings in any one of the plurality of blocks partially overlap with each other.

18. A printing control method for performing printing on a print medium by dividing a plurality of printing elements into a plurality of blocks and time-divisionally driving the respective blocks, comprising the steps of:

designating the respective blocks such that periods of designating the respective blocks partially overlap with each other; and time-divisionally driving a plurality of printing elements in a designated block such that timings of driving the plurality of printing elements within the designated block partially overlap with each other.

19. The method according to claim 18, further comprising the step of printing by discharging ink from discharge orifices provided in correspondence with said printing elements.

20. The method according to claim 19, wherein said printing elements discharge the ink by generating thermal energy.

21. The method according to claim 18, wherein successively designated blocks to be driven in the plurality of blocks are designated by a first signal and a second signal whose phase is shifted from that of the first signal.

22. The method according to claim 18, wherein time-divisionally driven timings in any one of the plurality of blocks partially overlap with each other.

23. A printing apparatus that performs printing on a print medium by dividing a plurality of printing elements included in a printhead into a plurality of blocks and time-divisionally driving the respective blocks, comprising:

selection-signal generation output means for generating selection signals by using at least two circuits corresponding to at least two structurally-adjacent blocks among said plurality of blocks, to select said at least two blocks, and outputting the selection signals to said printhead;

drive-signal generation output means for generating at least two drive signals to drive printing elements included in said respective two structurally-adjacent blocks and outputting the at least two drive signals to said printhead; and control means for output-controlling the selection signals such that drive-start timings of said at least two structurally-adjacent blocks are different from each other, and controlling said selection-signal generation output means and said drive-signal generation output means to control start and end of outputs of the at least two drive signals such that a period of driving printing elements included in one block of said at least two structurally-adjacent blocks and a period of driving printing elements included in another block overlap with each other.

24. A printing control method for performing printing on a print medium by dividing a plurality of printing elements included in a printhead into a plurality of blocks and time-divisionally driving the respective blocks, comprising:

a selection-signal generation output step of generating selection signals by using at least two circuits corresponding to at least two structurally-adjacent blocks among said plurality of blocks, to select said at least two blocks, and outputting the selection signals to said printhead;

a drive-signal generation output step of generating at least two drive signals to drive printing elements included in said respective two structurally-adjacent blocks and outputting the at least two drive signals to said printhead; and a control step of output-controlling the selection signals such that drive-start timings of said at least two structurally-adjacent blocks are different from each other, and controlling said selection-signal generation output step and said drive-signal generation output step to control start and end of outputs of the at least two drive signals such that a period of driving printing elements included in one block of said at least two structurally-adjacent blocks and a period of driving printing elements included in another block overlap with each other.

25. A printhead that performs printing on a print medium by dividing a plurality of printing elements into a plurality of blocks and time-divisionally driving the respective blocks, comprising:

at least two selection-signal generation output circuits that generate and output at least two selection signals in correspondence with at least two structurally-adjacent blocks among said plurality of blocks, to select said at least two structurally-adjacent blocks from said plurality of blocks; and a drive signal receiving unit that receives at least two drive signals to drive printing elements included in said respective at least two structurally-adjacent blocks;

wherein the at least two selection signals are output-controlled such that drive start timings of said at least two structurally-adjacent blocks are different from each other, and wherein control is performed by the at least two drive signals such that a period of driving printing elements included in one block of said at least two structurally-adjacent blocks and a period of driving printing elements included in another block overlap with each other.

* * * * *